United States Patent [19]

Lipari

[11] Patent Number: 4,880,396

[45] Date of Patent: Nov. 14, 1989

[54] COAXIAL CONNECTOR

[75] Inventor: Dominic T. Lipari, Reynoldsburg, Ohio

[73] Assignee: American Telephone and Telegraph Company, AT&T Bell Laboratories, Murray Hill, N.J.

[21] Appl. No.: 207,674

[22] Filed: Jun. 16, 1988

[51] Int. Cl.[4] ..... H01R 17/04
[52] U.S. Cl. ..... 439/578
[58] Field of Search ..... 439/578–585

[56] References Cited

U.S. PATENT DOCUMENTS

| | | | |
|---|---|---|---|
| 3,437,982 | 4/1969 | O'Keefe et al. | 439/578 |
| 3,792,418 | 2/1974 | Kailus | 439/578 |
| 3,966,292 | 6/1976 | Schultz | 439/578 |
| 4,397,515 | 8/1983 | Russell | 339/117 |
| 4,426,127 | 1/1984 | Kubota | 339/177 |
| 4,639,068 | 1/1987 | McMills et al. | 439/584 |

*Primary Examiner*—Joseph H. McGlynn
*Attorney, Agent, or Firm*—L. H. Birnbaum

[57] ABSTRACT

Disclosed in a compact and inexpensive coaxial connector and jack assembly. The spring member which makes the ground connection to the coaxial cable is designed with sufficient rigidity so that the standard sleeve member surrounding the spring is eliminated.

8 Claims, 6 Drawing Sheets

COAXIAL CONNECTOR

BACKGROUND OF THE INVENTION

This invention relates to plugable coaxial connectors and a jack assembly employing such connectors.

Coaxial connectors are employed throughout high frequency systems whenever it is desired to connect the coaxial cable to some other element or to interface cables with some other system such as a lightwave communication system. As illustrated in FIG. 1, a typical female connector 10 employs a central connector element 11 surrounded partly by a housing 12 and partly by a leaf spring member 13. The leaf spring member is typically made of phosphor-bronze such that the leafs flare outwardly from the central connector 11 at one end. A sleeve 14 fits snugly over the spring member so that the leafs are compressed toward the central connector (but isolated therefrom) into a cylindrical pattern. Thus, when a coaxial cable plug (not shown) is inserted into the connector through opening 15 in the sleeve, the central connector element 11 makes mechanical and electrical contact with the signal portion of the plug, while the spring element makes mechanical and electrical contact with the grounded portion of the plug. (See, for example, U.S. Pat. No. 4,426,127 issued to Kubota.)

While connections of this design perform adequately, it is desirable to reduce the size and cost of plugable coaxial connectors.

SUMMARY OF THE INVENTION

This and other objects are achieved in accordance with the invention which, in one aspect, is a coaxial connector comprising a central connector element and an essentially cylindrical spring member surrounding at least a portion of the central connector element. The spring member includes a plurality of slots in a portion of its surface extending in a direction essentially parallel to the axis of the member.

In accordance with another aspect, the invention is a jack assembly including a plurality of coaxial connectors, each connector including a central connector element and an essentially cylindrical spring member surrounding at least a portion of the central connector element. The spring member includes a plurality of slots in a portion of its surface extending in a direction essentially parallel to the axis of the member.

BRIEF DESCRIPTION OF THE DRAWING

These and other features of the invention are delineated in detail in the following description. In the drawing.

It will be appreciated that for purpose of illustration, these figures are not necessarily drawn to scale.

DETAILED DESCRIPTION

Figure 1:
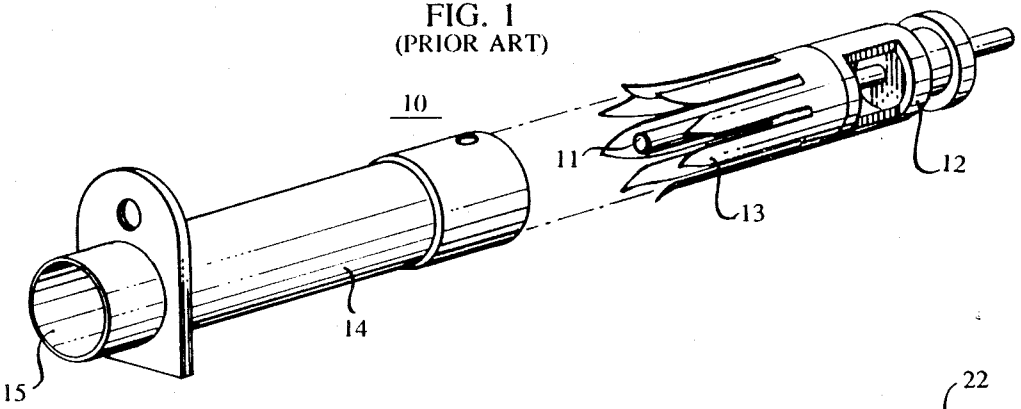
FIG. 1 (PRIOR ART)
FIG. 1 is an exploded, perspective view of a prior art coaxial connector.
Figure 2:
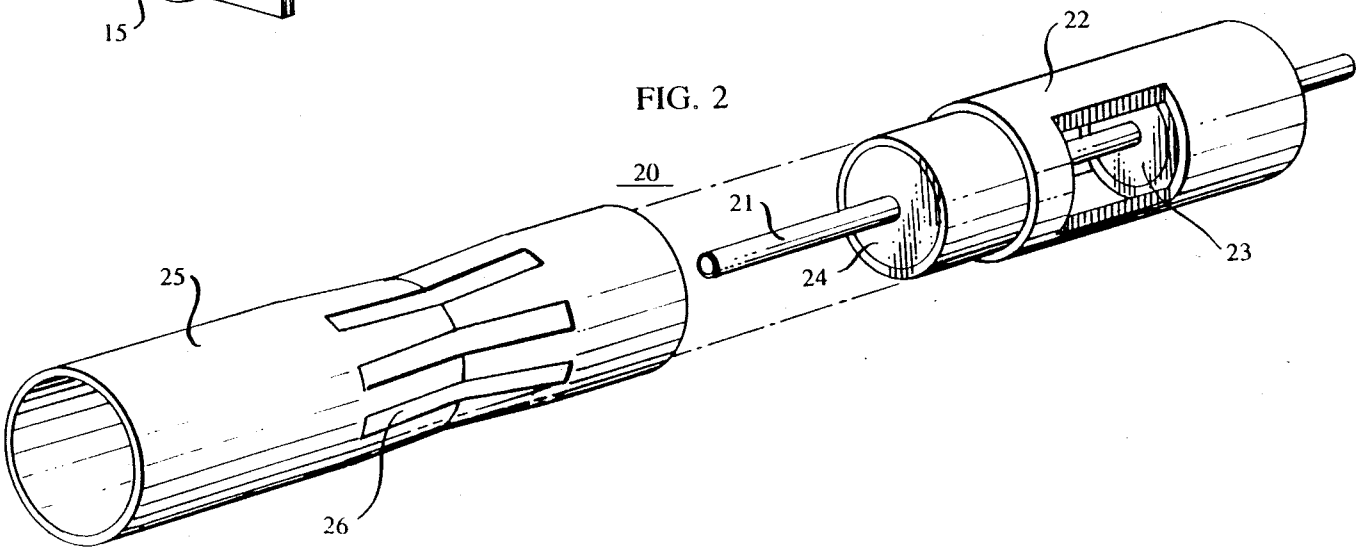
FIG. 2 is a perspective view of a coaxial connector in accordance with one embodiment of the invention.
Figure 3:
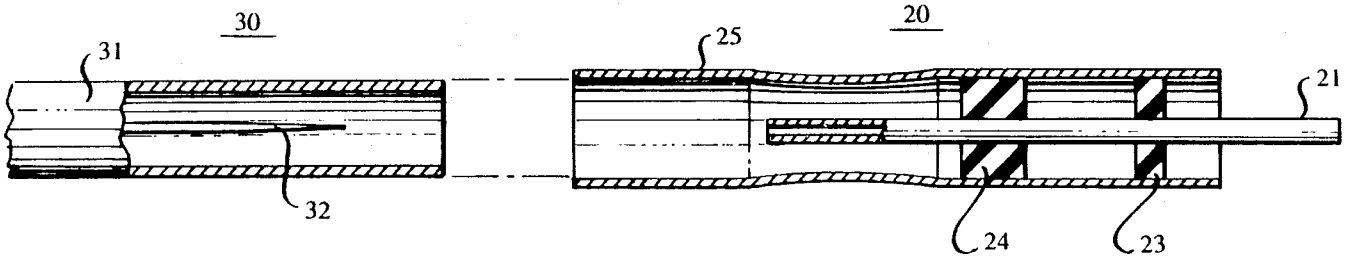
FIGS. 3 and 4 are cross-sectional views of the connector of FIG. 2 illustrating the insertion of a male plug of a coaxial cable.
Figure 4:
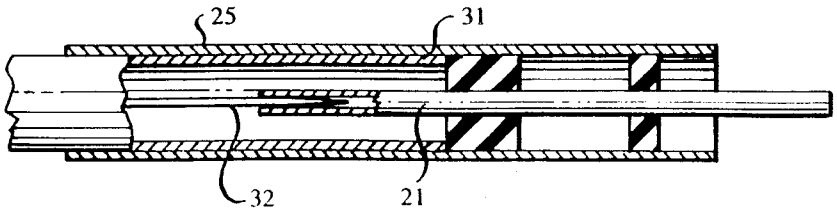

FIGS. 2–4 illustrate a connector in accordance with one embodiment of the invention. The connector 20 includes a central connector element 21 disposed within an essentially cylindrical housing or body 2. The connector element is electrically isolated from the housing by means of insulating plugs 23 and 24 in which the element is mounted. The housing and the central connector are typically made of phosphor-bronze, and the insulating plugs are made of Teflon®.

A spring element 25 is coupled adjacent to one end of the housing by attachment to the insulating plug 24 utilizing means such as welding and staking. The spring element is an essentially cylindrical conductor such as phosphor-bronze or brass with sufficient rigidity to withstand normal mating plug insertion forces to which the connector will be exposed. A portion of the spring element includes a plurality of slots 26 extending in the direction of the central connector element 21 (i.e., essentially parallel to the cylindrical axis of the spring element).

As more clearly shown in the cross-sectional view of FIG. 3, the slotted portion of the spring element is indented toward the central conductor element. The combination of the indentation and the slots provides a desired radial spring force for contacting the ground sleeve 31 of a male coaxial connector 30. Thus, as illustrated in FIG. 4, when the male plug is inserted into the spring element 25, the ground sleeve 31 fits snugly within the spring element 25 and tends to push the slotted portion outward. The spring force from the slotted portion therefore holds the male plug in place and maintains the ground connection between the two connectors. At the same time, the central connector 32 of the male plug is inserted within the central connector element 21 of the female connector to establish the signal contact between the two connectors. The signal and ground connections can be coupled to other connector means from the end of connector 20 by wires or other means.

It will be appreciated, therefore, that the spring element 25 is sufficiently rigid to act as a sleeve, and the slotted portion serves the spring function. The width of the slots determines the magnitude of the spring force, i.e., the wider the slots, the less the force applied by the element. In a typical example, the slots would be approximately 0.030 inches wide and 0.56 inches long. The slotted portion would typically be indented an amount of 0.016 inches.

Figure 5:
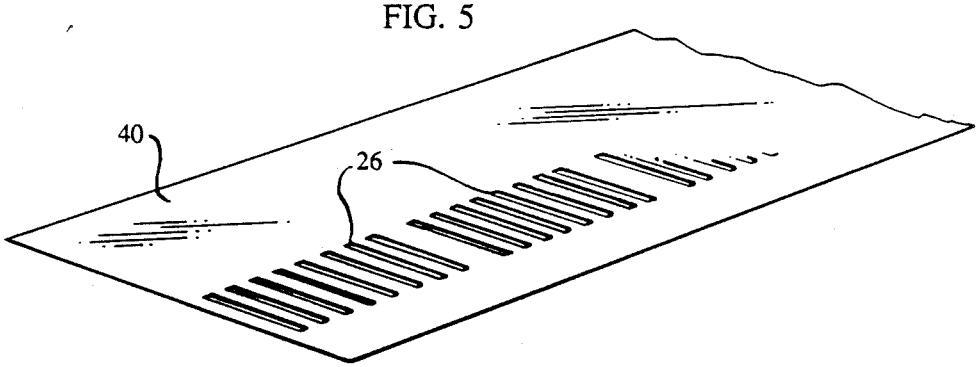
FIGS. 5–7 are perspective views of a portion of the connector of FIG. 2 during certain stages of fabrication.
Figure 6:
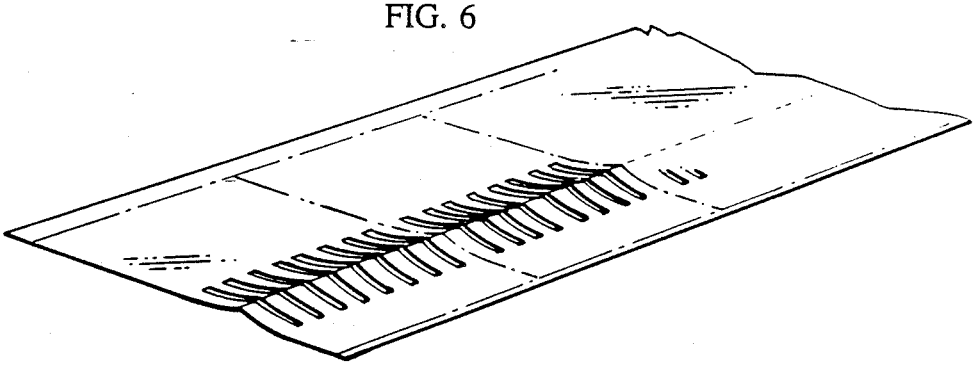
Figure 7:
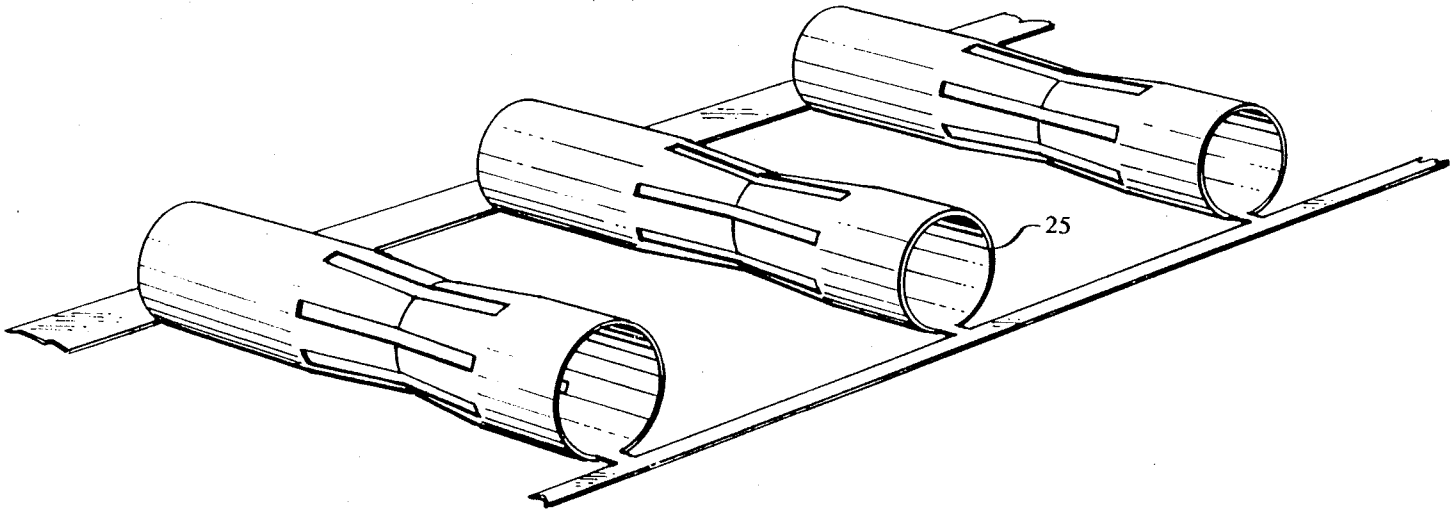

The spring element can be fabricated from flat stock utilizing standard punch and die tooling. As shown in FIG. 5, fabrication starts with a flat sheet of metal 40 which is typically phosphor bronze with a thickness of approximately 0.009 to 0.010 inches. The slots such as 26 are punched out in a parallel row as shown. Next, as illustrated in FIG. 6, a portion of the sheet which includes the slot is bent upward, for example by a forming tool. The sheet is then cut along the dashed lines to separate the sheet into individual spring elements. The cut-out portions are rolled on mandrels (not shown) to form the cylindrical shapes as illustrated in FIG. 7, and the ends of each element are joined by dove tail locks. The cylindrical elements can then be cut from the remaining portions of the sheet and attached to the body of a connector to produce the structure of FIG. 2.

Alternatively, the indentations of the slotted portions could be produced after the cylindrical shapes are formed, rather than in the flat stage, by squeezing the slotted portions inwardly. The spring element can also be formed from cylindrical rather than flat stock if desired.

Figure 8:
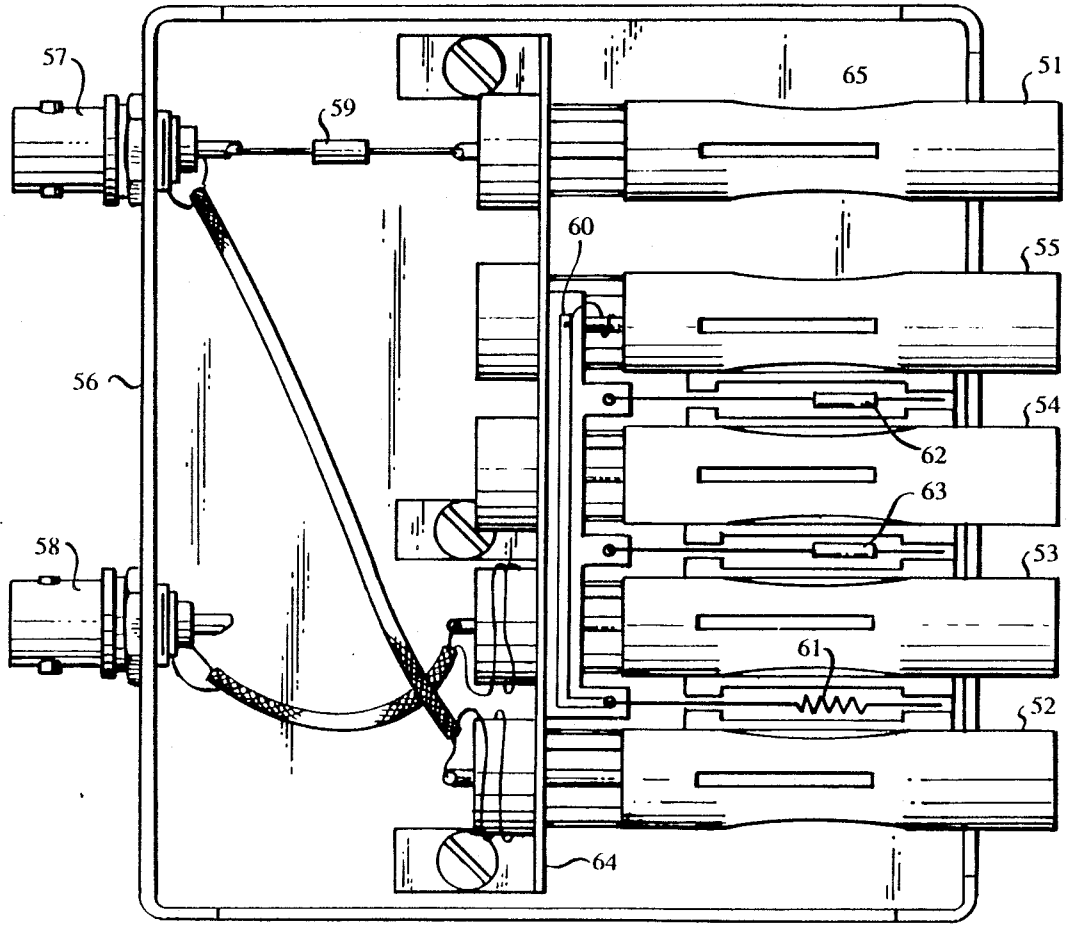
FIG. 8 is a plan view of an array of connectors in accordance with the same embodiment.

FIG. 8 illustrates a jack assembly including the connectors of the type shown in FIG. 2. This particular assembly includes five such connectors 51–55 mounted in a bar 64 within a housing 56. The central connector elements of two of the connectors (52 and 53) are electrically coupled to the signal portion of couplers (57 and 58, respectively), while the spring elements of those connectors are also coupled to the shield portion of those couplers. The couplers 57 and 58 are adapted to receive therein male connectors of coaxial cables which are connected to some type of equipment (not shown), such as digital signal transmission equipment.

Figure 9:
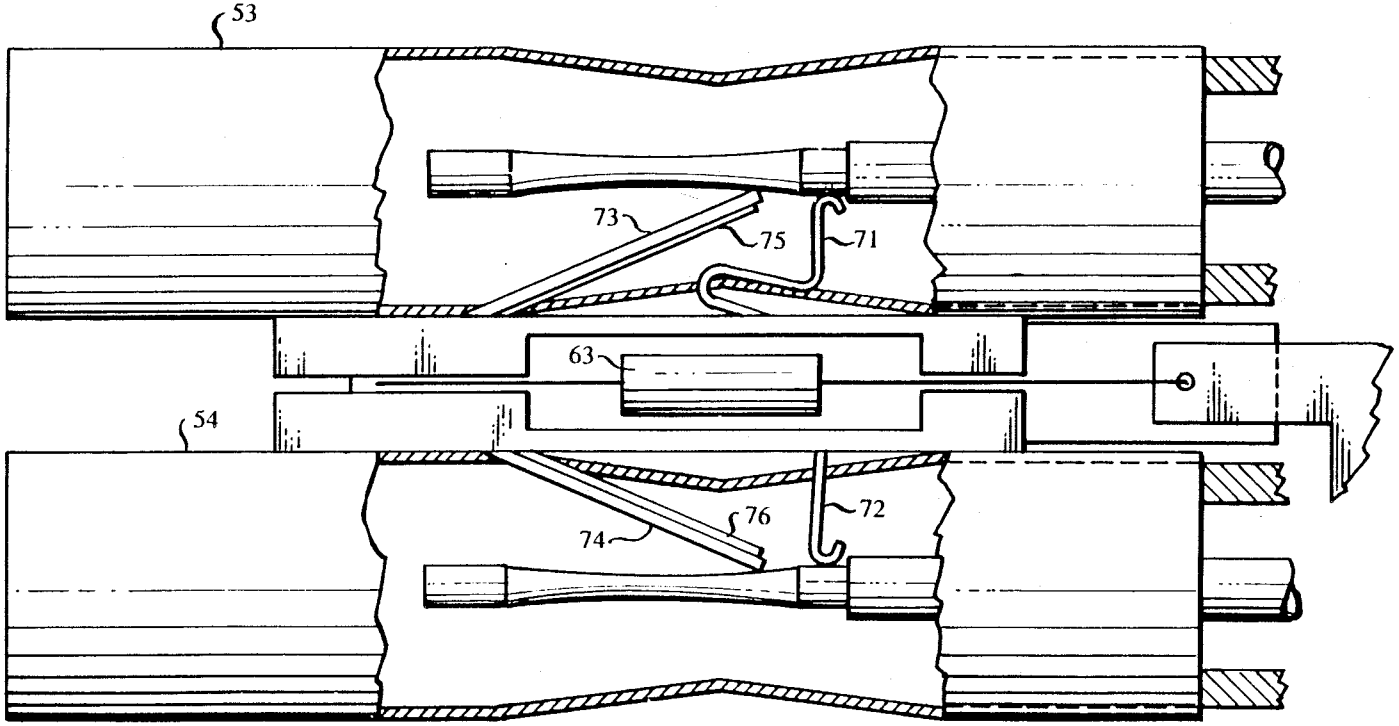
FIG. 9 is an enlarged, partly cut-away view of a portion of the device of FIG. 8.

There is a normally closed contact (part of which is shown as inductor 61) to the central conductor of connector 52 which bridges the signal from connector 57 through inductor 61 and printed wiring board 60 to the center conductor of connector 55. Ground connection is provided through bar 64 in which the connectors are mounted and which is mechanically coupled to the housing 56. This provides a fairly permanent connection between the outputs of two pieces of equipment when male plugs are inserted into connectors 55 and 57. Similarly, normally closed contacts of the center conductors of connectors 53 and 54 bridge the signal from connector 58 to connector 54 through resistor 63. This provides a fairly permanent connection between the inputs of two pieces of equipment when plugs are inserted into connectors 54 and 58. The normally closed contacts to the central conductors of connectors 53 and 54, by way of example, are shown in the enlarged, partly cut-away view of FIG. 9. Contact 71 will maintain physical and electrical contact to the center conductor until a plug is inserted in connector 53. Contact 72 will maintain physical and electrical contact to the center conductor of connector 54 at all times. Elements 73 and 74 which include conductive layers 75 and 76, respectively, provide ground paths for other connectors which become disconnected by insertion of a plug in a connector as explained below.

Connectors 52 and 53 provide the patching ports of the jack assembly. That is, insertion of a plug in connector 52 opens up the contact to the center connector which had bridged the output signal to connector 55 to break the connection between the output connectors (57 and 55) and provide access to the output connector 57 through connector 52. Similarly, insertion of a plug in connector 53 breaks the connection from connector 58 to connector 54 (by opening contact 71 of FIG. 9) to provide access to the input connector 58 through connector 53. Insertion of plugs into connector 52 and 53 will also couple, respectively, connectors 55 and 54 to the bar 64 through resistors 62 and 63, respectively, and the underside of printed circuit board 60 in order to properly terminate the equipment while the patching ports are being used. For example, referring to FIG. 9, insertion of a plug into connector 53 would disengage spring 71 from the center conductor of connector 53. However, element 75 would then make mechanical and electrical contact with a portion of contact 71 to provide an electrical path from the center conductor of connector 54 to ground through resistor 63. A spring contact (not shown) to the center conductor of connector 55 will terminate that conductor to ground through resistor 62 as long as no plug is inserted in connector 55.

Connector 51 is used as a monitoring port. That is, insertion of a plug into connector 51 provides access to the output coupler 57 through resistor 59. The spring member of connector 51 is connected to the housing 56 through bar 64, as are the spring members of all the connectors.

It will be appreciated that the spring elements of all the connectors in the jack assembly include an opening (e.g., 65 of connector 51 being partly visible) which permits access of adjacent spring contacts and resistors to the center conductors of the connectors. These openings are also formed in the portion of the spring element which includes the slots, but is typically wider and longer than the slots. For example, a typical opening would be approximately 0.207 inches wide and 0.750 inches long. These openings can be formed at the same time as the slots by including the larger openings adjacent to the slots while the spring material is in the form of a flat sheet.

Several variations in the connector and connector assembly are possible. For example, the spring member can be extended to cover the entire center conductor rather than be attached to a housing 22. The assembly of FIG. 8 can include any number of connectors and adjacent elements.

Various additional modifications will become apparent to those skilled in the art. All such variations which basically rely on the teachings through which the invention has advanced the art are properly considered within the scope of the invention.

What is claimed is:

1. A coaxial connector comprising a central connector element; and an essentially cylindrical spring member surrounding at least a portion of said central connector element, said member having an essentially circular opening at one end adapted to receive therein a coaxial plug having a signal and ground conductor such that the signal conductor makes electrical contact to the central connector element and the ground conductor makes electrical contact to the spring element, said member including a plurality of slots in a portion of its surface removed from said opening, said slots extending in a direction essentially parallel to the axis of the member, the slotted portion providing a sufficient spring force to hold the ground conductor in place and maintain electrical contact thereto in the absence of any additional elements concentric with said spring member.

2. The connector according to claim 1 wherein the central connector element is disposed within an essentially cylindrical housing, and the spring element is affixed adjacent to one end of the housing.

3. The device according to claim 1 wherein the slotted portion is indented toward the central connector element.

4. The device according to claim 1 wherein the spring element is made from a single piece of material.

5. The device according to claim 4 wherein the material is selected from the group consisting of phosphor-bronze and brass and has a thickness in the range 0.009–0.010 inches.

6. A jack assembly comprising a plurality of coaxial connectors, each connector including a central connector element and an essentially cylindrical spring member surrounding at least a portion of said central connector element, said member having an essentially circular opening at one end adapted to receive therein a coaxial plug having a signal and ground conductor such that the signal conductor makes electrical contact to the central connector element and the ground conductor makes electrical contact to the spring element, said member including a plurality of slots in a portion of its surface removed from said opening, said slots extending in a direction essentially parallel to the axis of the member, the slotted portion providing a sufficient spring force to hold the ground conductor in place and maintain electrical contact thereto in the absence of any additional elements concentric with said spring member.

7. The assembly according to claim 6 further comprising an electrical element disposed between adjacent connectors, at least one of said connectors also including an opening in the spring member to permit access of the electrical element to the central connector element.

8. The assembly according to claim 6 further comprising a housing surrounding said connectors, wherein the spring elements of the connectors are electrically coupled to the housing.

* * * * *

UNITED STATES PATENT AND TRADEMARK OFFICE

CERTIFICATE OF CORRECTION

PATENT NO. : 4,880,396

DATED : November 14, 1989

INVENTOR(S) : Dominic T. Lipari

It is certified that error appears in the above-identified patent and that said Letters Patent is hereby corrected as shown below:

Column 2, line 8, Change "2" to --22--.

Signed and Sealed this

First Day of January, 1991

*Attest:*

HARRY F. MANBECK, JR.

*Attesting Officer*

*Commissioner of Patents and Trademarks*